US007343120B2

(12) United States Patent
Slattery et al.

(10) Patent No.: US 7,343,120 B2
(45) **Date of Patent: *Mar. 11, 2008**

(54) ADDITION OF LIQUID CHARGE CONTROL AGENTS TO TONER IN TONER DEVELOPMENT STATIONS OF ELECTROGRAPHIC REPRODUCTION APPARATUS

(75) Inventors: Scott T. Slattery, Brockport, NY (US); Peter S. Alexandrovich, Rochester, NY (US); Rodney R. Bucks, Webster, NY (US); Timothy J. Young, Williamson, NY (US); Brandon H. Brown, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 14 days.

This patent is subject to a terminal disclaimer.

(21) Appl. No.: 11/314,675

(22) Filed: Dec. 21, 2005

(65) Prior Publication Data

US 2007/0140741 A1 Jun. 21, 2007

(51) Int. Cl.
*G03G 15/08* (2006.01)

(52) U.S. Cl. ..... 399/253; 399/49; 399/61

(58) Field of Classification Search ..... 399/253, 399/49, 61

See application file for complete search history.

(56) References Cited

U.S. PATENT DOCUMENTS

| | | | | |
|---|---|---|---|---|
| 5,231,454 | A * | 7/1993 | Landa | 399/53 |
| 5,713,062 | A * | 1/1998 | Goodman et al. | 399/49 |
| 6,385,415 | B1 | 5/2002 | Hilbert et al. | 399/104 |
| 6,456,814 | B2 * | 9/2002 | Karasawa | 399/285 |
| 6,647,219 | B2 | 11/2003 | Buettner | 399/48 |
| 2004/0042815 | A1 | 3/2004 | Wayman et al. | |

* cited by examiner

*Primary Examiner*—David M. Gray
*Assistant Examiner*—Ruth N LaBombard
(74) *Attorney, Agent, or Firm*—Donna P. Suchy; Larry Kessler

(57) ABSTRACT

Controlling the charge on toner in a development station of an electrographic reproduction apparatus, wherein data relative to latent image charge carrying member voltage and image density control patches are sensed and development potential to achieve an aim density is calculated therefrom. A delta from an optimum development potential range is calculated, and in response to the determined delta, an amount of liquid charge control agent, from a supply of suitable liquid charge control agent, necessary to be added to the developer material in the development station to bring the toner to substantially a charge level that will enable a desired optimum developer potential is calculated. The calculated amount of liquid charge control agent is then injected directly into the development station.

9 Claims, 9 Drawing Sheets

ADDITION OF LIQUID CHARGE CONTROL AGENTS TO TONER IN TONER DEVELOPMENT STATIONS OF ELECTROGRAPHIC REPRODUCTION APPARATUS

CROSS-REFERENCE TO RELATED APPLICATION

This invention relates in general to co-pending U.S. patent application Ser. No. 11/314,676, filed on the same day herewith, entitled: ADDITION OF LIQUID CHARGE CONTROL AGENTS TO TONER IN TONER DEVELOPMENT STATIONS OF ELECTROPHOTOGRAPHIC REPRODUCTION APPARATUS, by Scott T. Slattery et al.

FIELD OF THE INVENTION

This invention relates in general to controlling charge of toner in toner development stations of electrographic reproduction apparatus, and more particularly, to addition of liquid charge control agents to toner in toner development stations of electrographic reproduction apparatus.

BACKGROUND OF THE INVENTION

In an electrographic process, a dielectric member, such as a photoconductive element, is initially uniformly electrically charged. An electrostatic latent image charge pattern is formed on the dielectric member by image-wise exposing the dielectric member to a suitable exposure source. For example, if the dielectric member is a photoconductive element, the photoconductive element is exposed by an exposure source such as a laser scanner or an LED array. The latent image charge pattern is developed into a visible image by bringing the electrostatic latent image charge pattern into close proximity to a developer material such as contained in a magnetic brush or other known type of development station. The developer material is typically formed of two or more components with non-marking magnetic carrier particles and marking non-magnetic toner particles adhering to the carrier particles. With the latent image charge pattern, on the dielectric member, in close proximity to the developer material, the toner particles are attracted, and adhere to, the dielectric member by the charge pattern. The resulting toner particle developed image is subsequently transferred to a receiver member, such as a paper or a plastic sheet for example, preferably by using an electrostatic field to urge the toner particles in the direction of the receiver member. The electrostatic field is commonly applied in one of several ways. For example, charge can be sprayed on to the back of a receiver member using a corona device. However, it is frequently preferable to use an electrically biased transfer roller to apply the field. Upon completion of the transfer of the toner particle developed image to a receiver member, the developed image is fused to the receiver member by application of heat and/or pressure, for example.

Many mechanisms serve to effect density of an image reproduced in an electrographic engine. When the dielectric member is a photoconductive element, photoconductive element voltages, developer station bias voltages, toner charge, transfer efficiencies from imaging members to receivers, and image fixing can all have an adverse effect on image density. Normally, closely controlling toner charge is attempted to achieve subsystem voltages that are manageable. This control can be accomplished in many ways. Toner concentration has a direct, inverse effect on the toner charge.

Dry chemical additives such as silicas, titanias, and stearates also affect the toner charge. Small particle additives such as silicas can be very helpful as transfer release agents, but can also add to the water content sensitivity of toner charge. Toner takeout rates and additive embedment are difficulties that can affect the toner charge in a way that is not controllable. The addition of these additives also adds cost and time to toner production.

One of the larger contributors to the toner charge variability, is the environmental conditions that occur in and around the development station. As water content increases, toner charge decreases. Warmers, driers, humidifiers, and additives have been used to combat or control this, all with an eye to controlling the effect of water on the toner charge. U.S. Patent Application Publication No. 2004/0042815, published on Mar. 4, 2004, in the names of Wayman et al., shows a humidification system for a development station to control charge on toner particles for developing a latent image charge pattern. The humidification is provided by adding water vapor to an airflow directed into the development station. The addition of water vapor is not as precise as would be required to enable an accurate control over the toner particle charge.

SUMMARY OF THE INVENTION

In order to minimize the problems associated with varying toner charge in the development station of an electrographic reproduction apparatus due to variability in water content, this invention provides for supplying a liquid charge control agent additive directly into the development station in a controllable fashion on a constant basis. These liquid charge control agents directly affect the charge on the toner and are removed from the development station by several mechanisms including evaporation and the removal of toner from the developer material during development of the latent image charge pattern. The liquid charge control agents are added at single or multiple points into the development station via well-controlled nozzles capable of controlling addition of the liquid by single shot amount and also by the number of shots released.

According to this invention, in controlling the charge on toner in a development station of an electrographic reproduction apparatus, data relative to latent image charge carrying member voltage and image density control patches are sensed and development potential to achieve an aim density is calculated therefrom. A delta from an optimum development potential range is calculated, and in response to the determined delta, an amount of liquid charge control agent, from a supply of suitable liquid charge control agent, necessary to be added to the developer material in the development station to bring the toner to substantially a charge level that will enable a desired optimum developer potential is calculated. The calculated amount of liquid charge control agent is then injected directly into the development station.

Further, according to this invention, the device for controlling the charge on toner in a development station of an electrographic reproduction apparatus has a sensor associated with a latent image charge carrying member of the electrographic reproduction apparatus for sensing latent image charge carrying member voltage and providing a signal indicative thereof, and an additional sensor for sensing the transmission density of an image density control patch and providing a signal thereof as fully set forth in U.S. Pat. No. 6,647,219, issued on Nov. 11, 2003, in the name of Buettner. A logic and control device responsive to the respective signals from these sensors are used to calculate the development potential required to maintain an aim density, determine whether the development potential is within the optimum range of the electrographic reproduction apparatus, and in response to this determination, calculates an amount of liquid charge control agent necessary to be added to the toner in the development station to bring the toner to a charge value that will be substantially required to maintain the development potential in the optimum range. A supply for liquid charge control agent is provided, and an injector, operatively communicating between the liquid charge control agent supply and the toner development station, selectively supplies the calculated amount of liquid charge control agent from the supply to the toner development station.

Still further according to this invention, a method for controlling the charge on toner in a toner development station of an electrographic reproduction apparatus, provides the steps of calculating an amount of liquid charge control agent necessary to be added to the toner in the development station to bring the toner to substantially a charge value that will be required to maintain the development potential in an optimum range or to a desired aim development potential, and injecting the calculated amount of liquid charge control agent into the toner development station.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
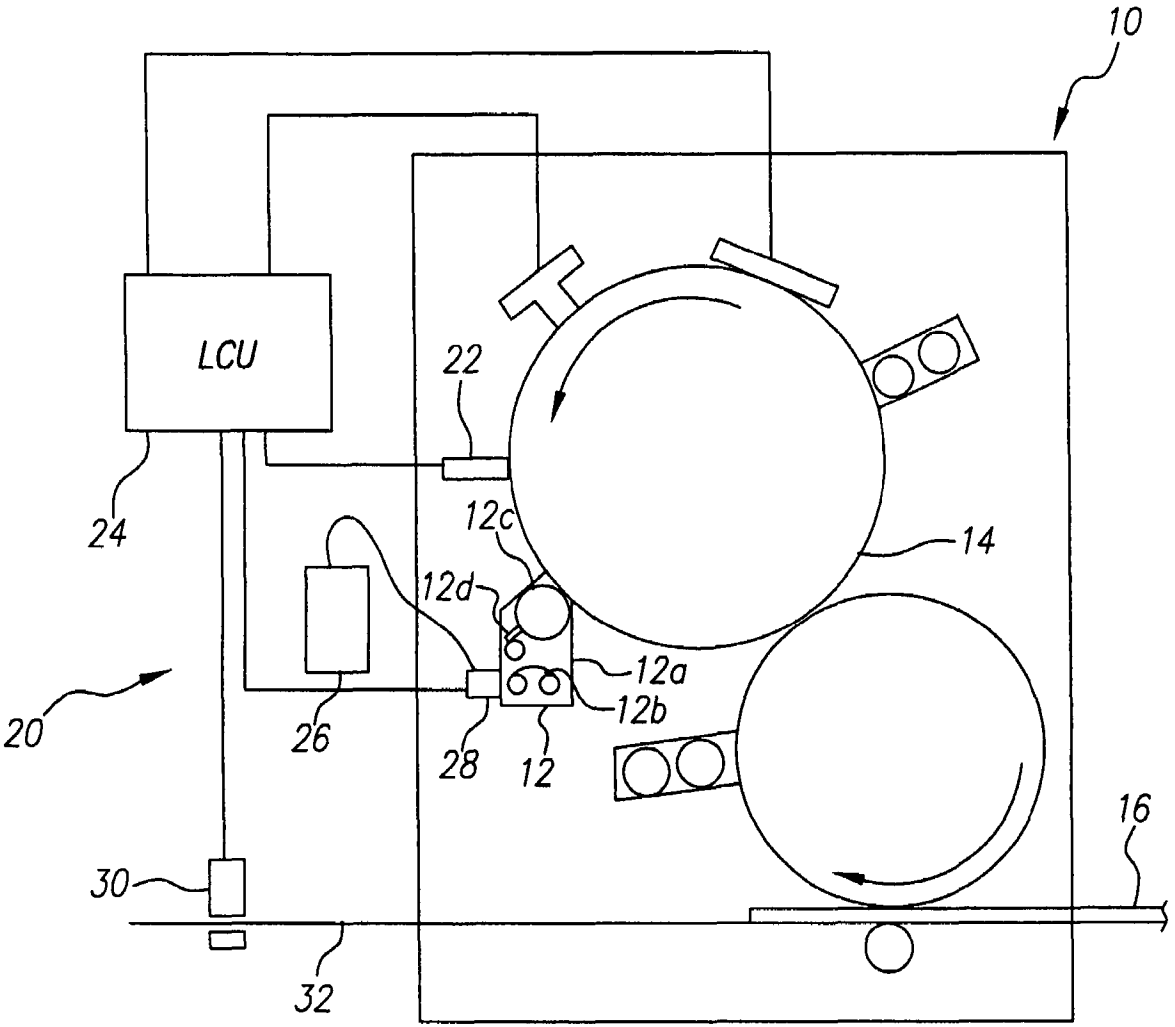
FIG. 1 is a schematic front elevational illustration of a portion of an electrographic reproduction apparatus including a development station utilizing a liquid charge control agent additive device according to this invention.

Referring now to the accompanying drawings, FIG. 1 shows, generally schematically, a portion of an electrographic reproduction apparatus generally designated by the numeral 10. In the electrographic reproduction apparatus 10, a toner development station 12 is provided for storing a supply of toner particles and selectively depositing toner particles on a latent image charge pattern carrying member 14. As discussed above, when the charge on the toner particles is at a proper level, the particles will develop the latent image charge pattern into a suitable visible image. Thereafter, the visible toner particle image is transferred to a receiver member 16, and is fixed to the receiver member, to form the desired image reproduction.

As fully described in U.S. Pat. No. 6,385,415, issued on May 7, 2002, in the names of Hilbert et al., one type of suitable magnetic brush development station 12 includes a housing 12*a* forming, in part, a reservoir for developer material (i.e., toner particles and carrier particles). A plurality of augers 12*b*, having suitable mixing paddles, stir the developer material within the reservoir of the housing 12*a* to thoroughly mix and charge developer. A development roller 12*c*, mounted within the development station housing 12*a*, includes a rotating multi-pole core magnet inside a rotating shell. Of course, the core magnet and the shell can have any suitable relative rotation. The quantity of developer material delivered from the reservoir portion of the housing 12*a* to a development zone associated with an image charge pattern carrying member 14 is controlled by a metering skive 12*d*, positioned parallel to the longitudinal axis of the development roller 12*c*, at a location upstream in the direction of shell rotation prior to the development zone.

According to this invention, a device, generally indicated by the numeral 20, is provided for controlling the charge on toner particles in the development station 12 of the electrographic reproduction apparatus 10, in order to assure proper (high quality) development of the latent charge pattern carried by the latent image charge pattern carrying member 14, and a subsequent high quality transfer of the toner particle developed image to a receiver member 16 transported in association therewith by any suitable transport mechanism 32. It has been determined that selectively adding liquid to developer material in a development station modifies the charge on the toner particles and enables control over the development potential, and other process control parameters (e.g., $V_{zero}$, toning bias, development potential, $V_{grid}$, exposure intensity, or exposure time) so as to provide a desired aim density at process conditions that optimize print image quality.

Figure 5:
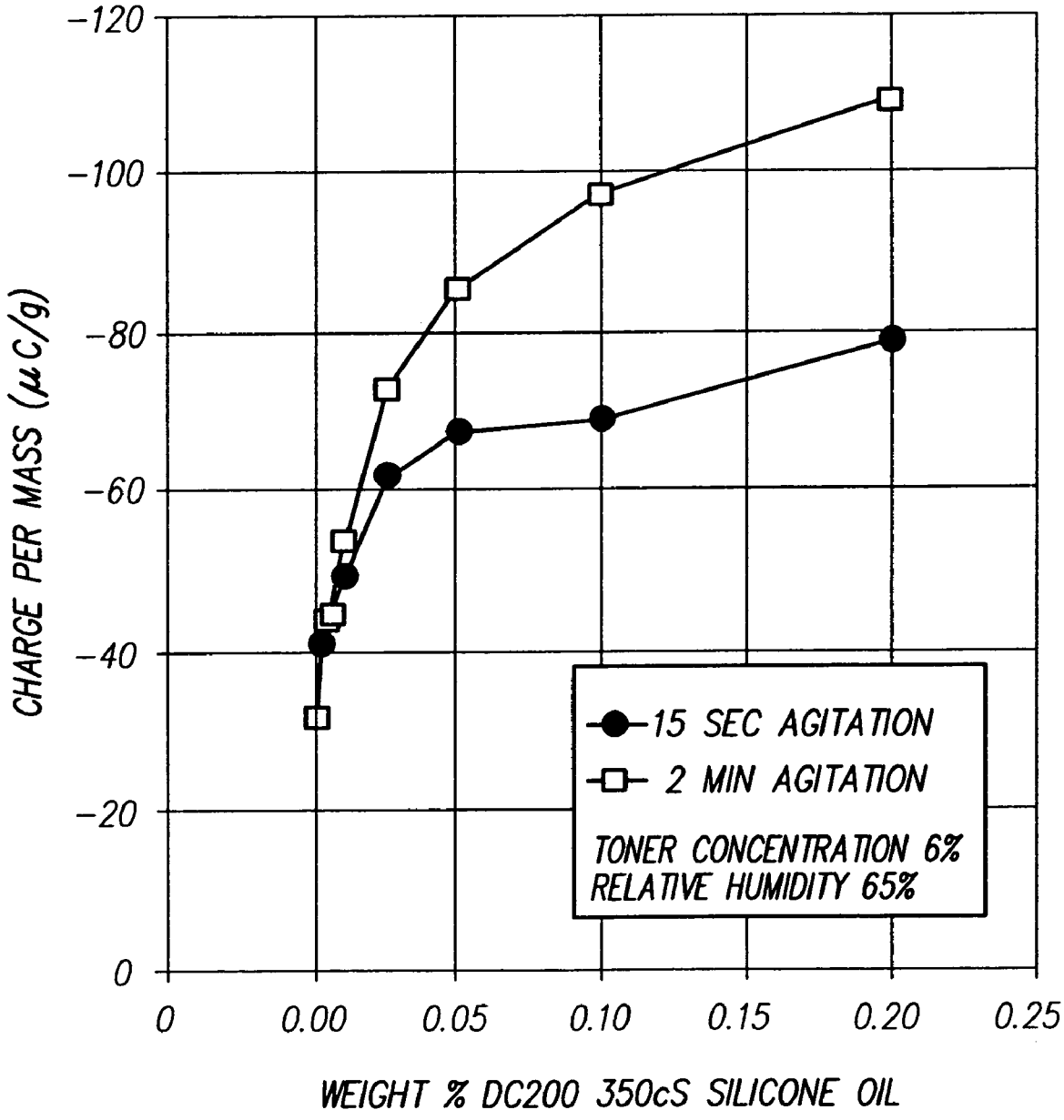
FIG. 5 is a graphical representation showing the change in charge to mass of toner particles vs. addition of weight percent of DC200 350 cS silicone oil liquid charge control agent to the electrographic reproduction apparatus toner development station according to this invention.

Suitable liquids can be provided which either lower or raise the charge potential of the toner particles. Such liquids must not be a solvent for toner, meaning that the liquid does not swell, plasticize, or dissolve the toner. Types of suitable liquids include water (for lowering charge) and alkane hydrocarbons or silicone liquids (for raising charge). FIG. 5 shows an exemplary plot of the effect on the charge potential of toner by adding a liquid (silicone oil) to the toner. Use of the addition of a liquid to increase or decrease the charge per mass of a two-component developer is illustrated in the following examples (references below).

EXAMPLE 1

DC200, polydimethylsiloxane (silicone oil) of 350 cS viscosity, was obtained from Dow Coming. A series of mixtures of increasing concentration of this silicone fluid were prepared with the cyan two-component developer from the Kodak NexPress 2100 printer. The NexPress developer comprises 6% cyan polyester resin based toner, and 94% strontium ferrite carrier with a resin coating. The developer/silicone mixtures were agitated in vials on a wrist shaker device for either 15 seconds or 2 minute; charge per mass was measured in the MECCA apparatus. This involves placing the 100 milligram sample of the charged developer in a sample dish situated between electrode plates and subjecting it, simultaneously for 30 seconds, to a 60 Hz magnetic field and an electric field of about 2000 volts/cm between the plates. The toner is released from the carrier and is attracted to and collects on the plate having polarity opposite to the toner charge. The total toner charge is measured by an electrometer connected to the plate, and that value is divided by the weight of the toner on the plate to yield the charge per mass of toner (Q/m) in micro-coulombs per gram of toner. The addition of the silicone fluid is seen to increase the charge per mass of the developer (see FIG. 5).

EXAMPLE 2

Figure 6:
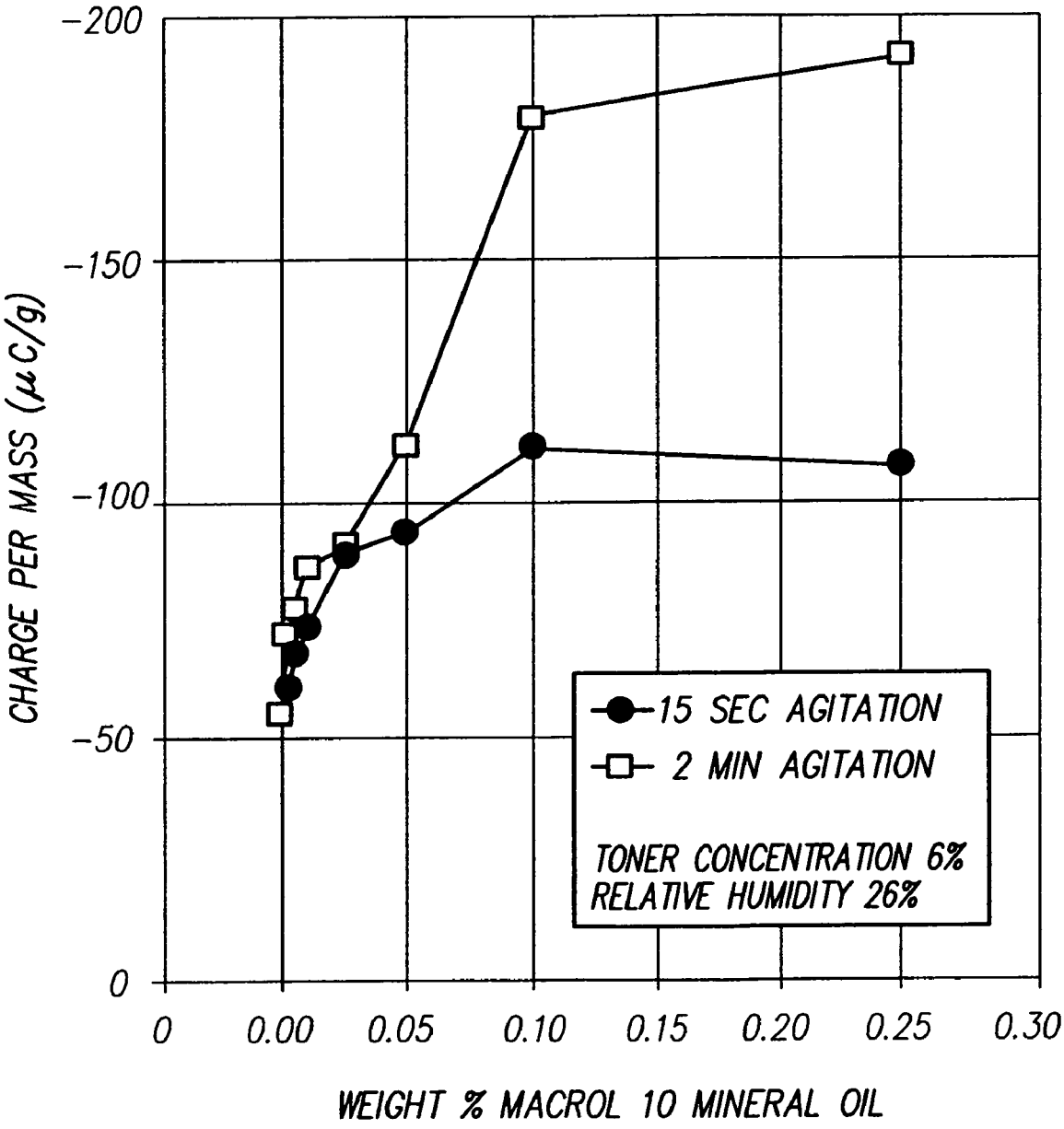
FIG. 6 is a graphical representation showing the change in charge to mass of toner particles vs. addition of weight percent of Marcol 10 mineral oil liquid charge control agent to the electrographic reproduction apparatus toner development station according to this invention.

Marcol 10 mineral oil (white oil) was obtained from Exxon-Mobil. A series of mixtures of increasing concentration of this alkane fluid were prepared with the cyan two-component developer from the Kodak NexPress 2100 printer. The NexPress developer comprises 6% cyan polyester resin based toner, and 94% strontium ferrite carrier with a resin coating. The developer/mineral oil mixtures were agitated in vials on a wrist shaker device for either 15 seconds or 2 minutes; charge per mass was measured by the MECCA method. The addition of the mineral oil is seen to increase the charge per mass of the developer (FIG. 6).

EXAMPLE 3

Figure 7:
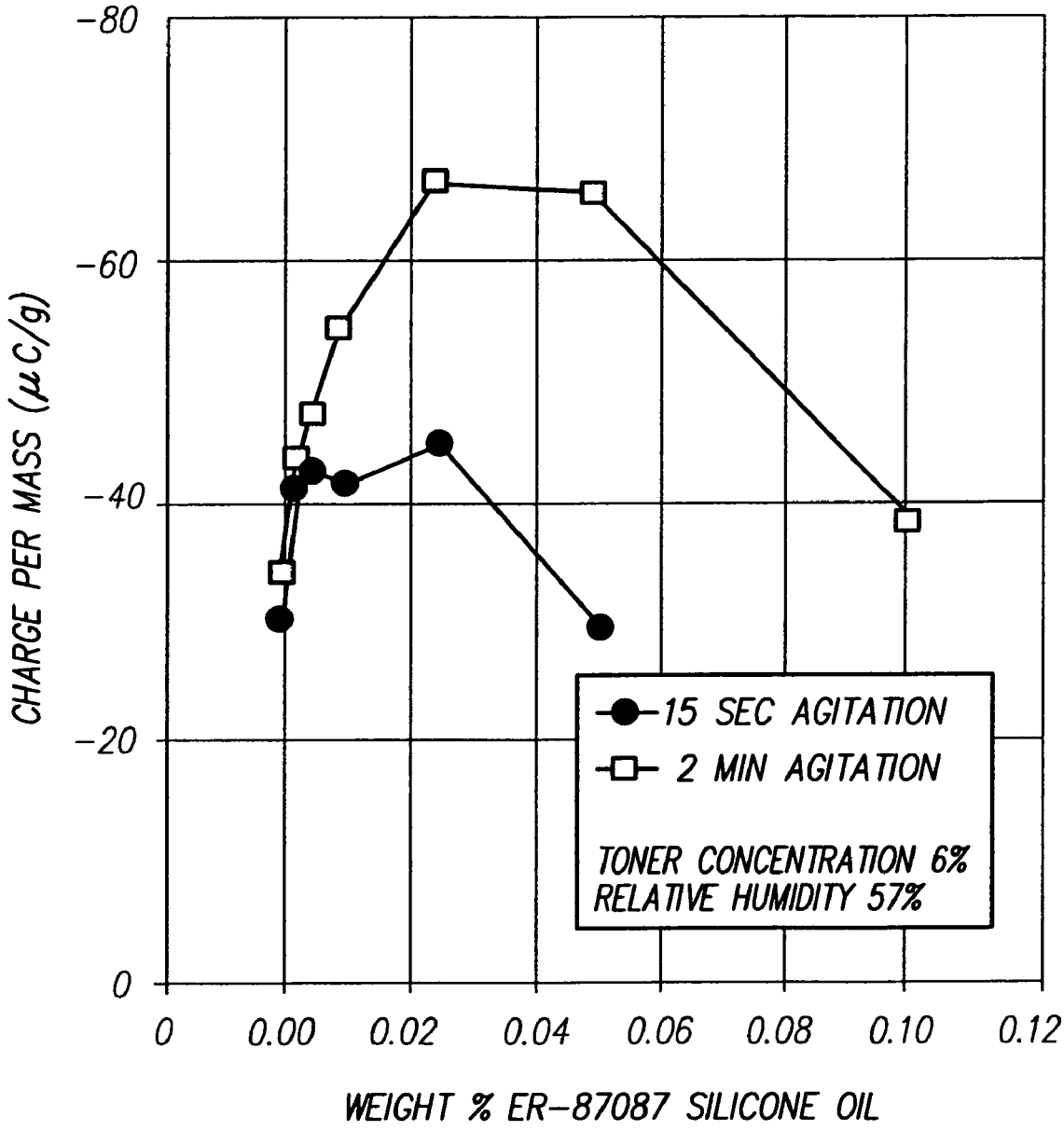
FIG. 7 is a graphical representation showing the change in charge to mass of toner particles vs. addition of weight percent of ER-87087 Silicone Oil liquid charge control agent to the electrographic reproduction apparatus toner development station according to this invention.

ER-87087, a silicone oil with amino functionality, was obtained from Wacker. A series of mixtures of increasing concentration of this silicone fluid were prepared with the cyan two-component developer from the Kodak NexPress 2100 printer. The NexPress developer comprises 6% cyan polyester resin based toner, and 94% strontium ferrite carrier with a resin coating. The developer/silicone mixtures were agitated in vials on a wrist shaker device for either 15 seconds or 2 minutes; charge per mass was measured by the MECCA method. The addition of the silicone fluid is seen to increase the charge per mass of the developer at the lowest levels tested, but then to decrease the charge per mass at higher levels. The difference in this behavior from that seen for DC200 unfunctionalized silicone (Example 1) is believed to be due to the amine groups on ER-87087; amine groups are known to have positive tribocharging effects (FIG. 7).

EXAMPLE 4

Figure 8:
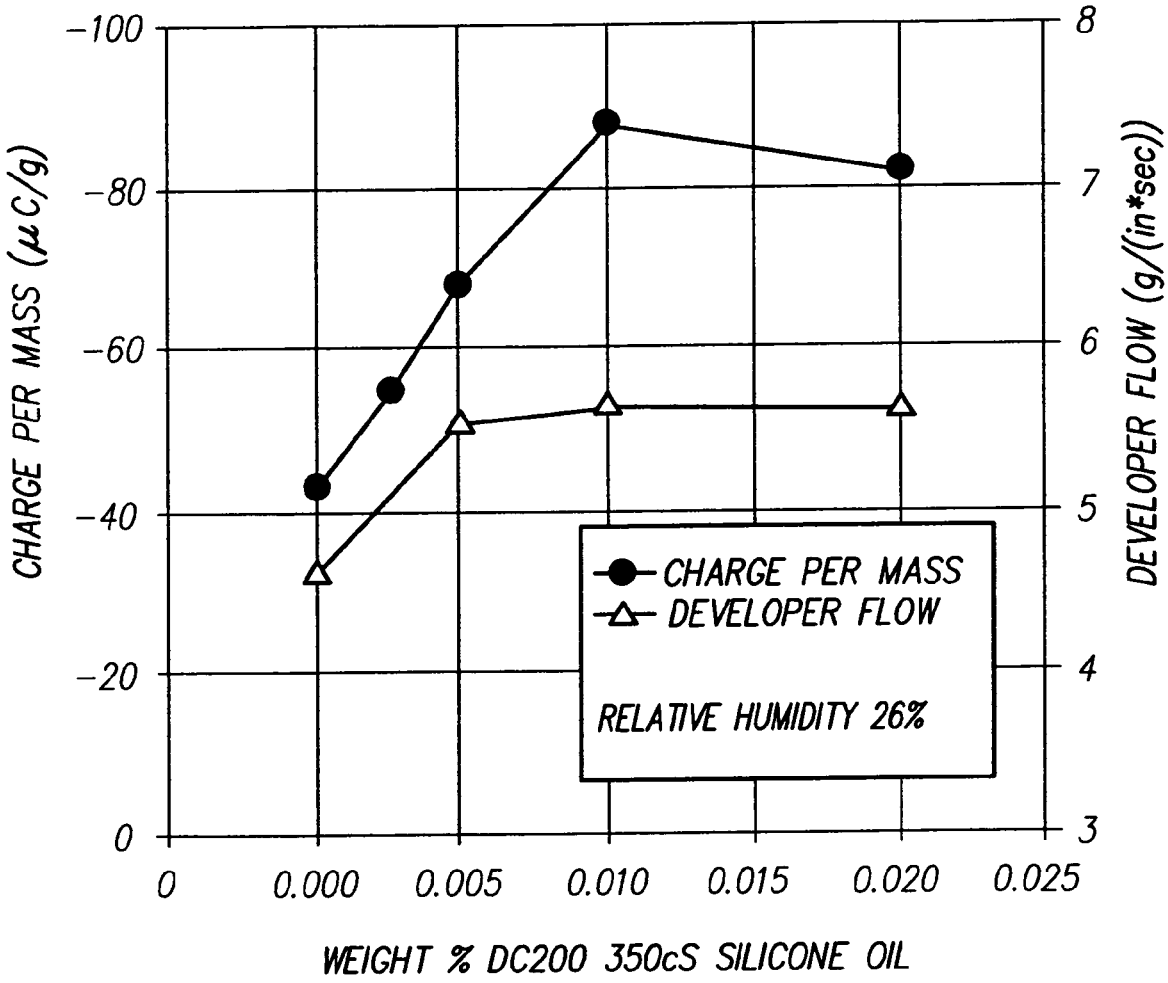
FIG. 8 is a graphical representation showing the change in charge to mass of toner particles vs. addition of weight percent of DC200 350 cS silicone oil liquid charge control agent to the electrographic reproduction apparatus toner development station according to this invention vs. developer flow.
Figure 9:
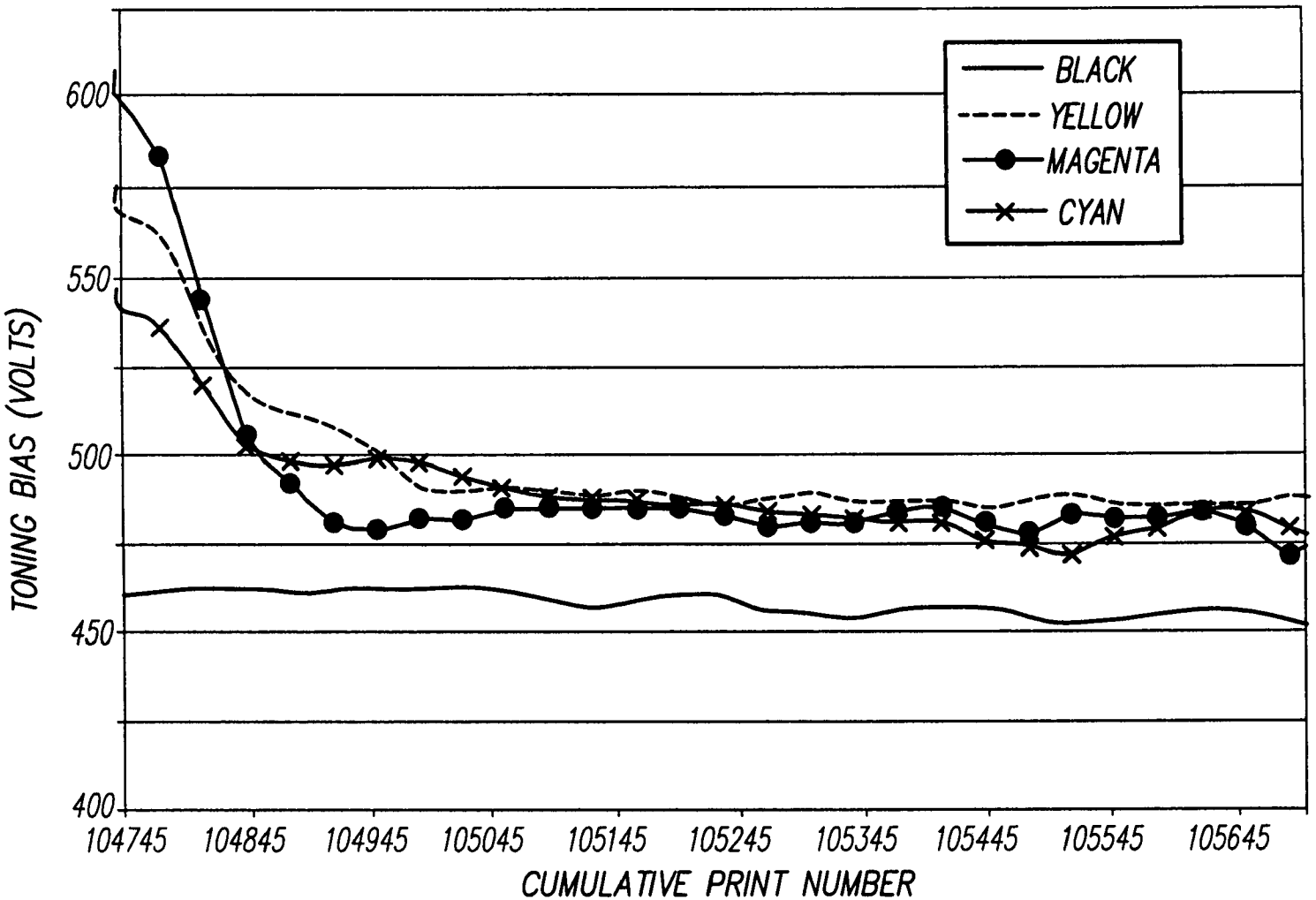
FIG. 9 is a graphical representation showing the change in process voltages over a series of prints, with the addition of water liquid charge control agent to the electrographic reproduction apparatus development station according to this invention vs. developer flow.

The yellow developer from the Kodak NexPress 2100 printer was exercised for 1 hour in a toning station from the Kodak NexPress 2100 printer. The toning station was operated on a bench-top so as to be able to access the magnetic-brush toning roller to make developer flow measurements. Increments of DC200 silicone (350 cS from Dow Coming) were added directly into the mixing sump and charge per mass and developer flow over the toning roller measurements were made after 1 minute agitation in the toning station after the addition of each increment. It is seen that the charge per mass increase in the toning station is similar to that seen in Examples 1 through 3 where the agitation of the developer was done in vials. There is also an observed increase in developer flow, which is believed to be caused by decreased cohesiveness of the developer (see FIG. 8).

EXAMPLE 5

A yellow developer from the Kodak NexPress 2100 printer was exercised for 10 minutes in a toning station from the Kodak NexPress 2100 printer. The toning station was operated on a bench-top. Increments of water were added directly into the mixing sump, and charge per mass was measured by the MECCA method after 1 minute of agitation in the station after each addition. Table 1 shows that the addition of water to the two-component developer results in a decrease in charge per mass.

TABLE 1

Water Addition to Two-Component Developer

| Increment (Weight %) | Charge/Mass (μC/g) |
|---|---|
| 0 | −18.4 |
| 0.007 | −17.5 |
| 0.008 | −16.0 |
| 0.015 | −13.3 |

EXAMPLE 6

A series of prints was run on a Kodak NexPress 2100 printer. The respective color development stations had increments of water added directly into the mixing sumps of the development stations. In this example, the water addition was controlled by an algorithm that monitored the toning station bias. An aim toning station bias was chosen as 465 V. For cyan, magenta, and yellow, the toning bias was higher than the aim and water was injected into the development station. As water was injected into the toning station, the charge-to-mass of the toner decreased and process control made adjustments to compensate for this addition. Water injection continued until the charge-to-mass was lowered sufficiently so that the process control adjustments lowered the toning bias to approximately 465 V. Water injection then continued at a slower rate to maintain this lower toning potential. Water was not injected into the black station, as its toning bias was lower than or equal to 465 V.

It should be noted that in all of the examples cited above there was no indication that the liquid charge agent was solvent for the toner. In none of the examples was any aggregation of the developer or toner observed and there were no agglomerates or flakes in the developer or in printed images.

Referring again to FIG. 1, the device 20 includes a suitable sensor 22 associated with a latent image charge pattern carrying member 14 of the electrographic reproduction apparatus and a sensor 30 associated with the receiver member transport mechanism 32. The sensor 22 senses the voltage of the latent image charge carrying member 14, and provides a signal indicative thereof. The sensor 30 senses the transmission density of an image density control patch developed by toner particles on the transport mechanism 32, and provides a signal indicative thereof.

The voltage signals from sensors 22 and 30 are sent to a logic and control device 24. The logic and control device 24 is a microprocessor based device, which receives input signals from an operator communication interface, and a plurality of other appropriate sensors (not shown) associated in any well-known manner with the electrographic stations of the reproduction apparatus 10. Based on such signals and suitable programs for the microprocessors, the logic and control device 24 produces appropriate signals to control the various operating devices and stations within the reproduction apparatus 10. The production of a program for a number of commercially available microprocessors is a conventional skill well understood in the art, and do not form a part of this invention. The particular details of any such program would, of course, depend upon the architecture of the designated microprocessor.

In response to signals from sensors 22 and 30, the logic and control device 24 calculates development potential required to maintain an aim image density for optimum print image formation, and based on a range of optimum development potentials stored in memory in the logic and control device 24, determines if the corresponding required development potential falls within a range that will produce high quality image prints. Subsequently, in response to the determination of whether the development potential falls within the optimum range, the logic and control device 24 calculates, if necessary, an amount of liquid charge control agent necessary to be added to the toner in the development station 12 to bring the toner therein to a charge level that is required to substantially maintain the development potential within the defined optimum range.

Figure 2:
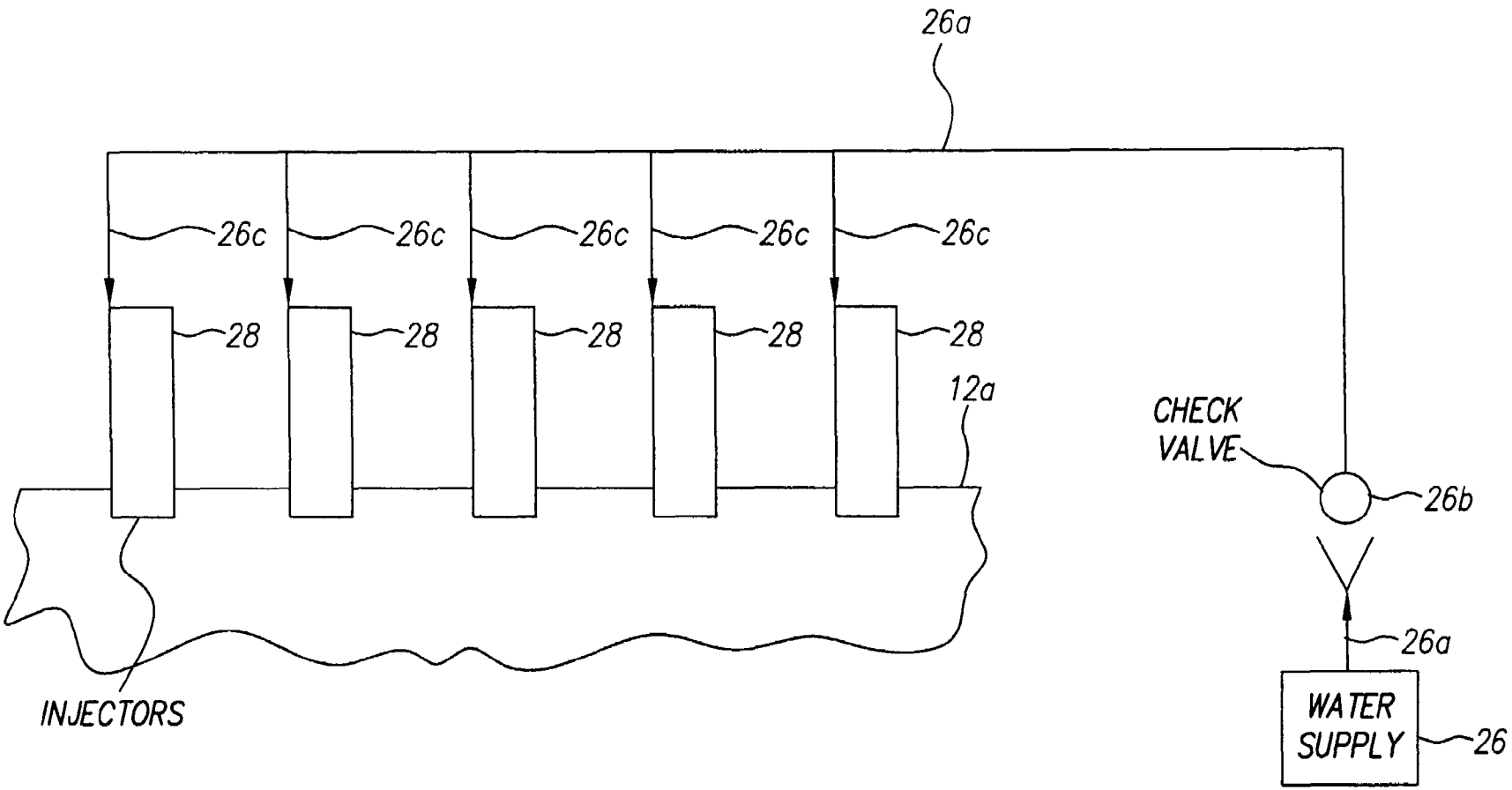
FIG. 2 is a schematic top plan view of a portion of a development station utilizing a liquid charge control agent additive device according to this invention.

The liquid charge control agent supply device 20 includes a supply reservoir 26 for liquid charge control agent. The supply reservoir 26 is associated with the development station 12 via any suitable conduit 26*a*. At least one injector 28 operatively communicates between the liquid charge control agent conduit 26*a* and the interior of the development station housing 12*a*. As shown in FIG. 2, the conduit 26*a* may include a check valve 26*b* to prevent back flow of the liquid charge control agent. Also, the conduit 26*a* may have a plurality of branches 26*c* to communicate with a plurality of injectors 28 respectively. The plurality of injectors may be distributed at suitable intervals along a longitudinal element of the development station housing 12*a*.

Figure 3:
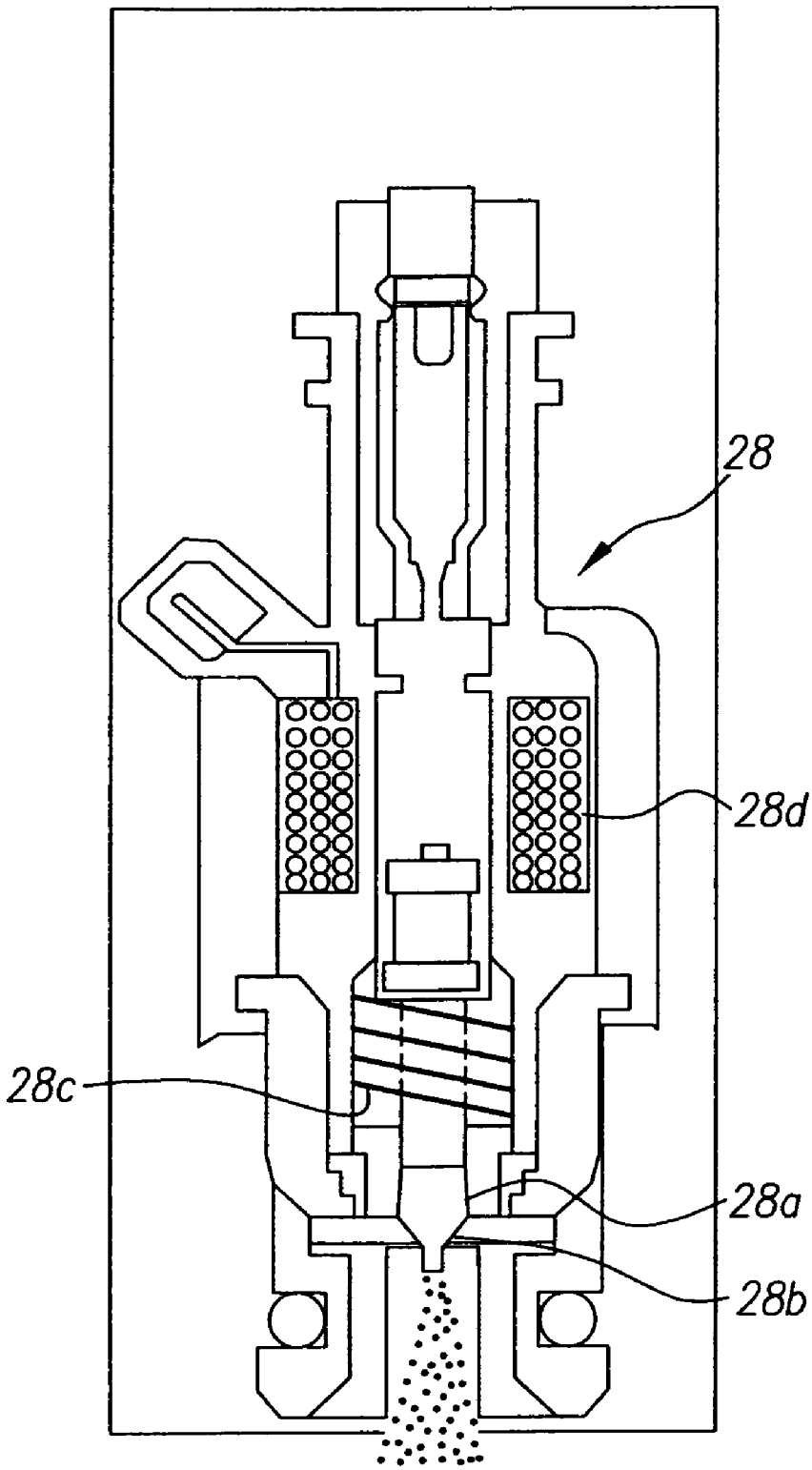
FIG. 3 is side view, in cross-section of an example of a fluid injector suitable for use with the liquid charge control agent additive device according to this invention.

A typical injector 28 capable of dispensing liquid charge control agent into a development station is shown in FIG. 3. The injector 28 is merely an electronically controlled valve having a plunger 28*a* for selectively opening and closing a port 28*b*. The plunger 28*b* is urged by a coil spring 28*c* in a direction to close the port 28*b*, and in a direction to open the port by an electromagnet 28*d*. Of course, other types of injectors, such as ultrasonic injectors or ink jet print heads, would be suitable for use with this invention. By controlling the action of the plunger 28*a* of the injector 28, the required amount of liquid charge control agent, as calculated by the logic and control device 24, is injected from the supply reservoir 26 into the toner development station 12 to enable liquid charge control agent to be directly provided into the interior of the development station to contact the toner particles.

Figure 4:
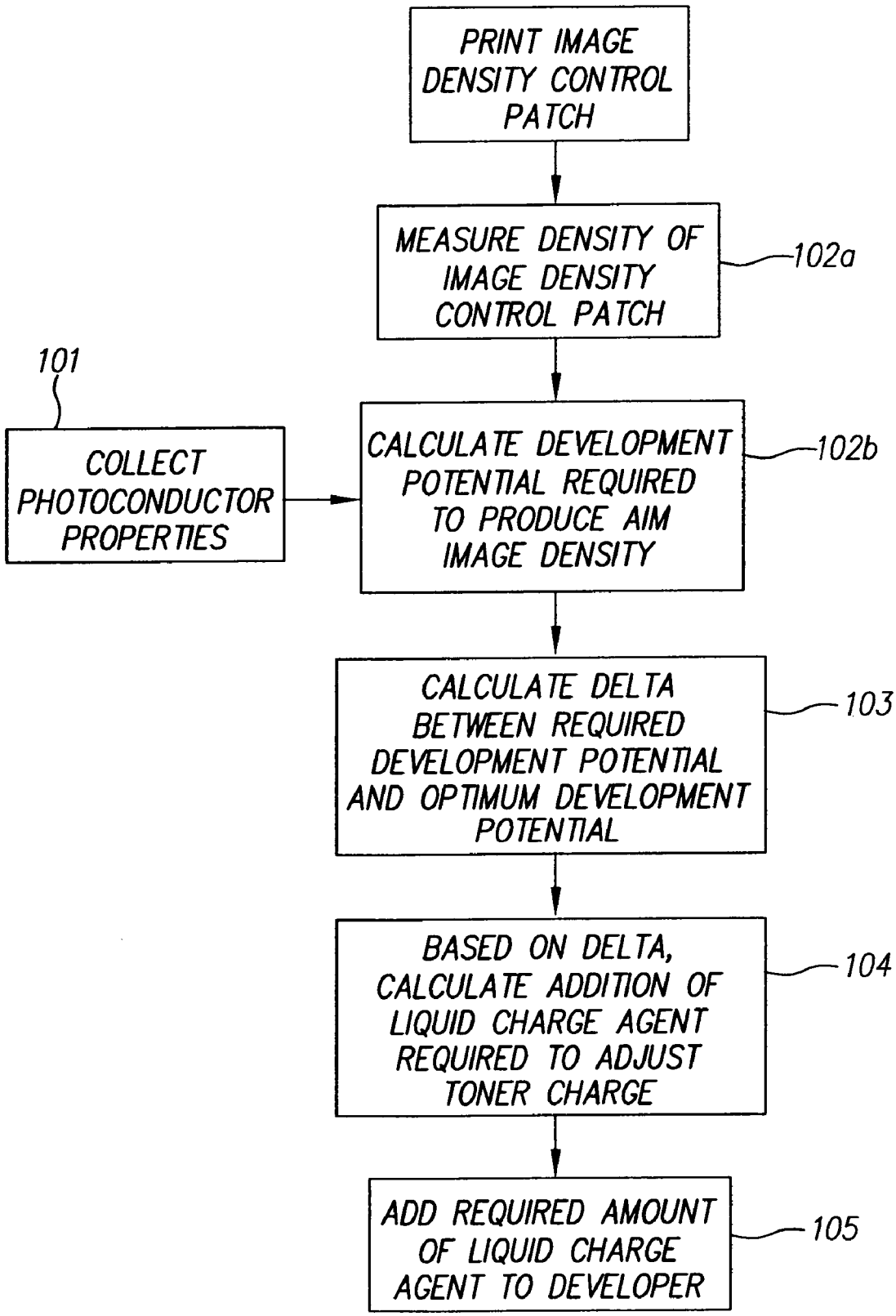
FIG. 4 is a flow chart for the process of adding liquid charge control agent to an electrographic reproduction apparatus toner development station according to this invention.

The process, according to this invention, for controlling charge of toner in development stations of electrographic reproduction apparatus is explained with reference to FIG. 4. In an electrographic reproduction apparatus with a development station for forming a developed image on a latent image charge pattern carrying member (as described above), having a supply of liquid charge control agent associated with the development station, in a first step 101, data relative to latent image charge carrying member properties (e.g., photoconductor voltage) are collected. In a second step 102*a*, an image density control patch is measured (at sensor 30) and the development potential required to achieve an aim density is calculated (step 102*b*). Thereafter, a determination of whether the required development potential is within the optimum development potential range is made, and a delta from the optimum range is calculated (step 103). If the liquid charge control agent is required, in response to the determined delta, an amount of liquid charge control agent necessary to be added to the toner in the development station to bring the toner to substantially a charge level that is needed to bring the development potential to within the desired optimum range is calculated (step 104). The calculated amount of liquid charge control agent is then injected into the toner development station (step 105). Of course it is understood that the arrangement of the liquid charge control agent reservoir and injector may be configured to provide separate, multiple, different acting charge control liquids for selectively raising or lowering the desired toner charge as determined.

The invention has been described in detail with particular reference to certain preferred embodiments thereof, but it will be understood that variations and modifications can be effected within the spirit and scope of the invention.

PARTS LIST

10 Electrographic reproduction apparatus
12 Development station
12*a* Development station housing
12*b* Augers
12*c* Development roller
12*d* Skive
14 Image carrying member
16 Receiver member
20 Liquid charge control agent supply device
22 Sensor
24 Logic and control device
26 Supply reservoir
26*a* Conduit
26*b* Check valve
26*c* Conduit branch
28 Injector
28*a* Plunger
28*b* Port
28*c* Spring
28*d* Electromagnet
30 Sensor
32 Receiver transport mechanism

What is claimed is:

1. A device for controlling the charge on a two-component particulate developer, including particulate toner, in a development station of an electrographic reproduction apparatus, comprising:

a supply of liquid charge control agent; and at least two separably controllable injectors, operatively communicating between said liquid charge control agent supply and said development station, to selectively supply a quantity of charge control agent necessary to adjust the charge-to-mass ratio of the development station particulate toner to a desirable range or value wherein the at least two separably controllable injectors comprise one injector for one of an alkane hydrocarbon, silicone liquid and one injector for a water-based liquid.

2. The device for controlling the charge on toner in a development station of an electrographic reproduction apparatus of claim 1 wherein said liquid charge control agent will raise the charge level by increasing the charge to mass ratio of the developer station particulate toner.

3. The device for controlling the charge on toner in a development station of an electrographic reproduction apparatus of claim 1 wherein said liquid charge control agent will lower the charge level by decreasing the charge to mass ratio of the developer station particulate toner.

4. The device for controlling the charge on toner in a development station of an electrographic reproduction apparatus of claim 1 wherein one liquid charge control agent is water.

5. A device for controlling The charge on two-component particulate developer, including particulate toner, in a development station of an electrographic reproduction apparatus, comprising:

a supply of liquid charge control agent; and at least one injector, operatively communicating between said liquid charge control agent supply and said development station, to selectively supply a quantity of charge control agent necessary to adjust one or more process control parameters of the electrographic process to a desirable range or value wherein the at least one controllable injector injects said liquid charge control agent comprising one of water, an alkane hydrocarbon and a silicone liquid at a first rate to adjust the toner charge and at a second rate to maintain The toner charge.

6. A device for controlling the charge on a two-component particulate developer, including particulate toner, in a development station of an electrographic reproduction apparatus, comprising:

a supply of liquid charge control agent; and at least two injectors, operatively communicating between said liquid charge control agent supply and said development station, to selectively supply a quantity of charge control agent necessary to adjust one or more of $V_{zero}$, toning bias, development potential, $V_{grid}$, exposure intensity, or exposure time to a desirable range or value wherein the at least two separably controllable injectors comprises one injector for water and another injector for an alkane hydrocarbon or a silicone liquid.

7. A device for controlling the charge on toner in a development station of an electrographic reproduction apparatus for storing two-component particulate developer including particulate toner having a charge, the charge control device, comprising:

a sensor associated with a latent image charge carrying member of the electrographic reproduction apparatus for sensing latent image charge carrying member voltage and providing a signal indicative thereof;

a sensor associated with a transport mechanism for sensing a toner particle developed image density patch and providing a signal thereof;

a logic and control device responsive to said signals from said sensor for latent image charge carrying member voltage and said developed image density patch, determining the delta from an optimum development potential range, and in response to the determined delta, calculating an amount of liquid charge control agent necessary to be added to the particulate toner in the development station to bring the particulate toner substantially to a charge level that will provide a desired optimum developer potential;

a supply for liquid charge control agent; and at least one injector, operatively communicating between said liquid charge control agent supply and said development station, to selectively supply the calculated amount of liquid charge control agent from said supply to said development station wherein the at least one controllable injector injects said liquid charge control agent wherein said liquid charge control agent includes water and an alkane hydrocarbon or a silicone liquid so as to selectively lower or raise the toner charge.

8. The device for controlling the charge on toner in a development station of an electrographic reproduction apparatus of claim 7 wherein there are at least two separably controllable injectors, and said liquid charge control agent for one injector includes water and said liquid charge control agent for another injector is an alkane hydrocarbon or a silicone liquid added directly into a mixing sump of the developer station.

9. A device for controlling the charge on toner in a development station of an electrographic reproduction apparatus for storing two-component particulate developer including particulate toner having a charge, the charge control device comprising:

a sensor associated with a latent image charge carrying member of the electrographic reproduction apparatus for sensing latent image charge carrying member voltage and providing a signal indicative thereof;

a sensor associated with a transport mechanism for sensing a toner particle developed image density patch and providing a signal thereof;

a logic and control device responsive to said signals from said sensor for latent image charge carrying member voltage and said developed image density patch, determining the delta from an optimum development potential range, and in response to the determined delta, calculating an amount of liquid charge control agent necessary to be added to the particulate toner in the development station to bring the particulate toner substantially to a charge level that will provide a desired optimum developer potential;

a supply for liquid charge control agent; and at least one injector, operatively communicating between said liquid charge control agent supply and said development station, to selectively supply the calculated amount of liquid charge control agent from said supply to said development station wherein the at least one controllable injector injects said liquid charge control agent wherein said liquid charge control agent is water.

* * * * *